US005381716A

United States Patent [19]

May et al.

[11] Patent Number: 5,381,716

[45] Date of Patent: Jan. 17, 1995

[54] TREMOLO SYSTEM FOR STRINGED INSTRUMENTS

[76] Inventors: Christopher May, Low Herdley, Coanwood, Nr Haltwhistle, Northumberland, NE49 0QT; John Wakefield, Mapledean, Longwick Road, Princes Risborough, Buckinghamshire, HP17 9HN, both of Great Britain

[21] Appl. No.: 170,284

[22] PCT Filed: Jul. 2, 1992

[86] PCT No.: PCT/GB92/01194

§ 371 Date: Jan. 4, 1994

§ 102(e) Date: Jan. 4, 1994

[87] PCT Pub. No.: WO93/01586

PCT Pub. Date: Jan. 21, 1993

[30] Foreign Application Priority Data

Jul. 4, 1991 [GB] United Kingdom ..... 9114467

[51] Int. Cl.[6] ..... G10D 3/00

[52] U.S. Cl. ..... 84/313; 384/4; 384/543

[58] Field of Search ..... 84/313; 384/4, 154, 384/156, 543

[56] References Cited

U.S. PATENT DOCUMENTS

| | | | |
|---|---|---|---|
| 494,885 | 4/1893 | Perkins | 384/543 |
| 1,508,438 | 9/1924 | Batcheller | 384/543 |
| 4,361,365 | 11/1982 | Witchey | 384/4 |
| 4,563,934 | 1/1986 | Keizer | 84/313 |
| 4,903,568 | 2/1990 | Itoh | 84/313 |
| 4,932,302 | 6/1990 | Saijo | 84/313 |
| 4,944,208 | 7/1990 | Kusek | 84/313 |
| 5,083,492 | 1/1992 | Gorr | 84/313 |
| 5,196,641 | 3/1993 | Schaller | 84/313 |

*Primary Examiner*—Michael L. Gellner
*Assistant Examiner*—Eddie C. Lee
*Attorney, Agent, or Firm*—Larson and Taylor

[57] ABSTRACT

A tremolo system for a stringed instrument includes a base plate (10) secured to the upper surface of the body (2) of the instrument and provided with a transverse slot (12) feeding into a hollow volume (6) within the body (2), the base plate carrying a pair of laterally opposed first bearing portions (20) located within the body (2) one below each end of the transverse slot (12), and a block member (22) carrying second bearing portions (24) co-operating with the first bearing portions (20) whereby the block member (22) is pivotal about an axis extending transversely of the body (2) below the upper surface thereof. A tremolo lever (30) is secured to an upper extent (26) of the block member (22) projecting from the slot (8), while resilient mechanisms (34) react between a lower extent (36) of the block member (22) and the body (2) to maintain the block member (22) in a position of equilibrium against the tension of the strings (4). Movement of the lever (30) pivoting the block member (22) alters the tension in the strings (4).

5 Claims, 3 Drawing Sheets

30
28
26
10
18
18
20
24
24
20
32
22
6

30
28
26
10
18
22
2
32

TREMOLO SYSTEM FOR STRINGED INSTRUMENTS

BACKGROUND OF THE INVENTION

This invention relates to a tremolo system for stringed instruments.

Many modern day guitars are equipped with devices and mechanisms which enable the tension in the strings to be dynamically altered whereby the pitch or tone of the sound produced by the strings can be varied.

Conventional tremolo devices incorporate a pivotal lever which is usually located on the front of the guitar body adjacent to the high 'E' string, the performer first of all playing a note or cord and then moving the tremolo lever to alter the tension in the relevant string and to obtain the desired effect.

Perhaps the most notable and successful tremolo devices are those of Fender Musical Instruments Corporation and D Floyd Rose introduced in the 1950s and the 1970s respectively.

The Fender device involves what is now considered as relatively conventional or traditional machining of the guitar to provide a slot in the upper surface of the guitar body, and an L-shaped volume within the guitar body below said slot. The tremolo lever is integral with a base plate or bridge assembly to which one end of each guitar string is attached, one edge of the base plate being screwed to the guitar body to be pivotal about said screws on movement of the lever against the bias of springs located within said volume in the guitar body and reacting between the guitar body and an extent of the base plate assembly projecting downwardly into said volume.

Such an arrangement, in which the base plate assembly moves with the tremolo lever, is acknowledged as providing excellent 'feel' to the performer and good sound quality, but suffers from certain disadvantages. In particular there is limited movement available to the tremolo lever in a direction tensioning the strings before the base plate of the assembly interferes with the surface of the guitar body, while pivoting movement of the lever and the consequential movement of the base plate assembly causes the strings themselves to be raised and lowered relative to the guitar body. This can result in contact of the strings with the fingerboard and/or undesirable alteration in the fine tuning of the strings.

Instead of pivoting the base plate about screws, the Floyd Rose device incorporates fixed pivots screwed to the guitar body, the movable base plate to which the tremolo lever is attached being provided with a knife edge which seats on said pivots to pivot thereabout on movement of the lever against a spring arrangement similar to that of Fender.

The Floyd Rose device suffers from some of the disadvantages associated with Fender, although the upper surface of the guitar body is shaped to enable pivoting of the base plate in both directions. However this requires additional machining of otherwise conventional guitar bodies.

A further known tremolo system by Kahler departs from the pivotal base plate arrangement and provides an integral block adapted to be located into a suitably machined recess in the body of the guitar. This system embodies a base plate fixed to the body of the guitar and a bearing arrangement mounted in the block above the surface of the guitar body about which the tremolo lever is pivotal against the bias of springs contained within the block.

Although there is less undesirable movement of the strings than in the aforementioned systems, the Kahler arrangement requires the provision of special purpose springs and a roller to keep the system in equilibrium, and involves a large amount of machining to the instrument body prior to installation. Furthermore, the sound produced by the Kahler system is generally inferior to that of Fender or Floyd Rose systems, there being no direct resilient connection between the lever and the body of the instrument as is provided by the balancing springs in the latter systems.

SUMMARY OF THE INVENTION

It would be desirable to be able to provide a tremolo system for a stringed instrument which overcame the disadvantages of the systems mentioned above whilst still retaining a quality sound to the instrument.

According to the present invention there is provided a tremolo system for a stringed instrument having a body in the upper surface of which is formed a transverse slot feeding into a hollow volume within said body, the system comprising a base plate secured to the body of the instrument to surround and extend into said slot, the base plate carrying laterally opposed first bearing portions located within the body of the instrument one below each end of said transverse slot, and a block member carrying second bearing portions adapted to co-operate with said first bearing portions whereby the block member is pivotal about an axis extending transversely of the body of the instrument below the upper surface thereof, the block-member including an upper extent projecting from the slot and to which are secured the ends of the strings and a Tremolo lever, and a lower extent within said volume in the body, resilient means reacting between said lower extent of the block member and the body to maintain said block member in a rest position of equilibrium against the tension in the strings, the arrangement being such that movement of the lever pivots the block member from its rest position to a displaced position and alters the tension of the strings.

It will be appreciated that such a system can be mounted on a conventional stringed instrument without the necessity for any additional machining to the body, while the provision of a pivot axis for the tremolo lever and associated components below the upper surface of the instrument allows the height of the strings above the body of the instrument to remain substantially constant. Furthermore, the springs reacting between the block member and the body serve to transmit vibrations to the instrument body whereby a quality sound is produced by the instrument.

Preferably the volume within the body of the instrument is of generally L-shape in section taken longitudinally of the instrument, while it is further preferred that a section through the lower extent of the block member in a plane extending longitudinally of the instrument tapers towards the bottom of the instrument.

The resilient means conveniently comprise a plurality of transversely-spaced compression springs one end of each of which is attached to the lower extent of the block member and the other end of each of which is attached to the body of the instrument, said springs being housed within the lower regions of said L-shaped volume and extending parallel with the strings of the instrument. The tension in the springs may be selectively adjustable.

The first bearing portions may comprise a pair of opposed stub shafts mounted on the base plate, and the second bearing portions may comprise opposed annular bearing rings mounted one in each side of the block member to receive therein said stub shafts. Alternatively said first and second bearing portions may define a knife edge bearing assembly reacting between the block member and the base plate.

DESCRIPTION OF THE PREFERRED EMBODIMENT

Figure 1:
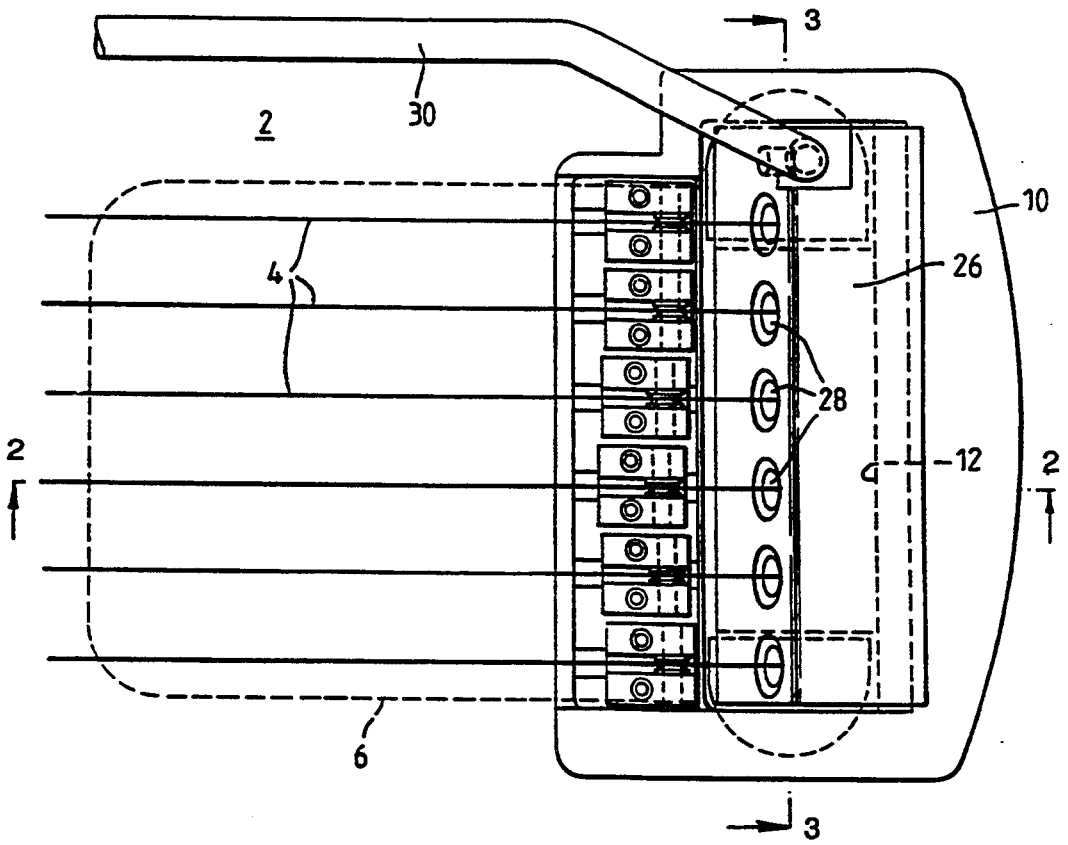
FIG. 1 is a plan view from above of part of a guitar incorporating a tremolo system according to the invention and showing the base plate and block member of the system.
Figure 2:
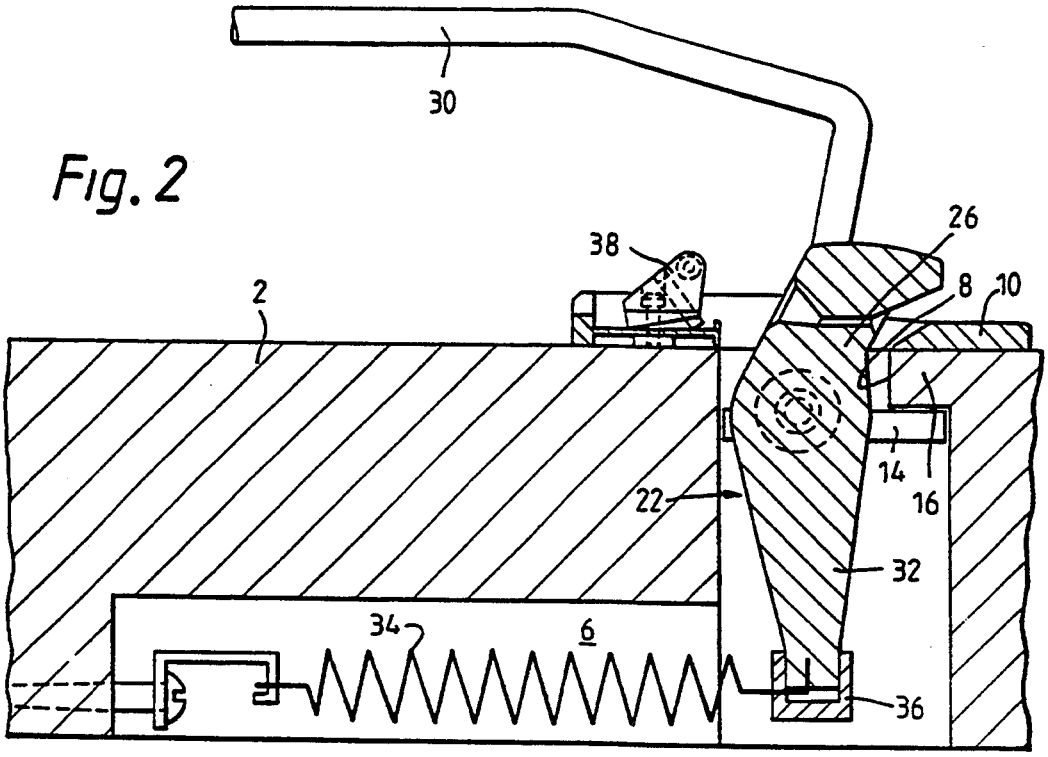
FIG. 2 is a longitudinal vertical section on the line 2—2 in FIG. 1.
Figure 4:
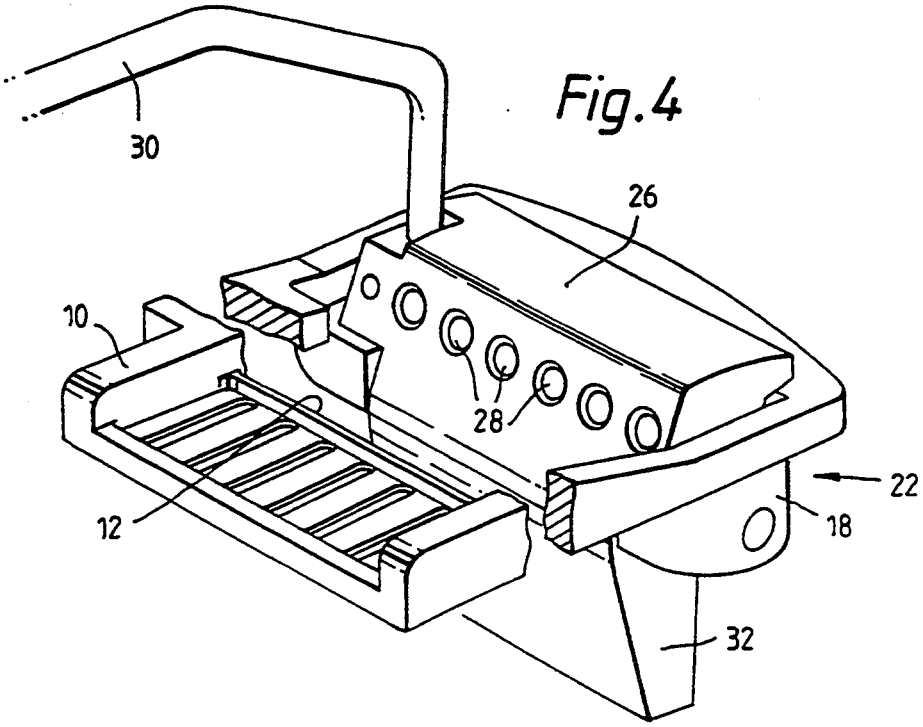
FIG. 4 is an isometric view of a base plate, partly cutaway, and a block member of a tremolo system according to the invention.
Figure 3:
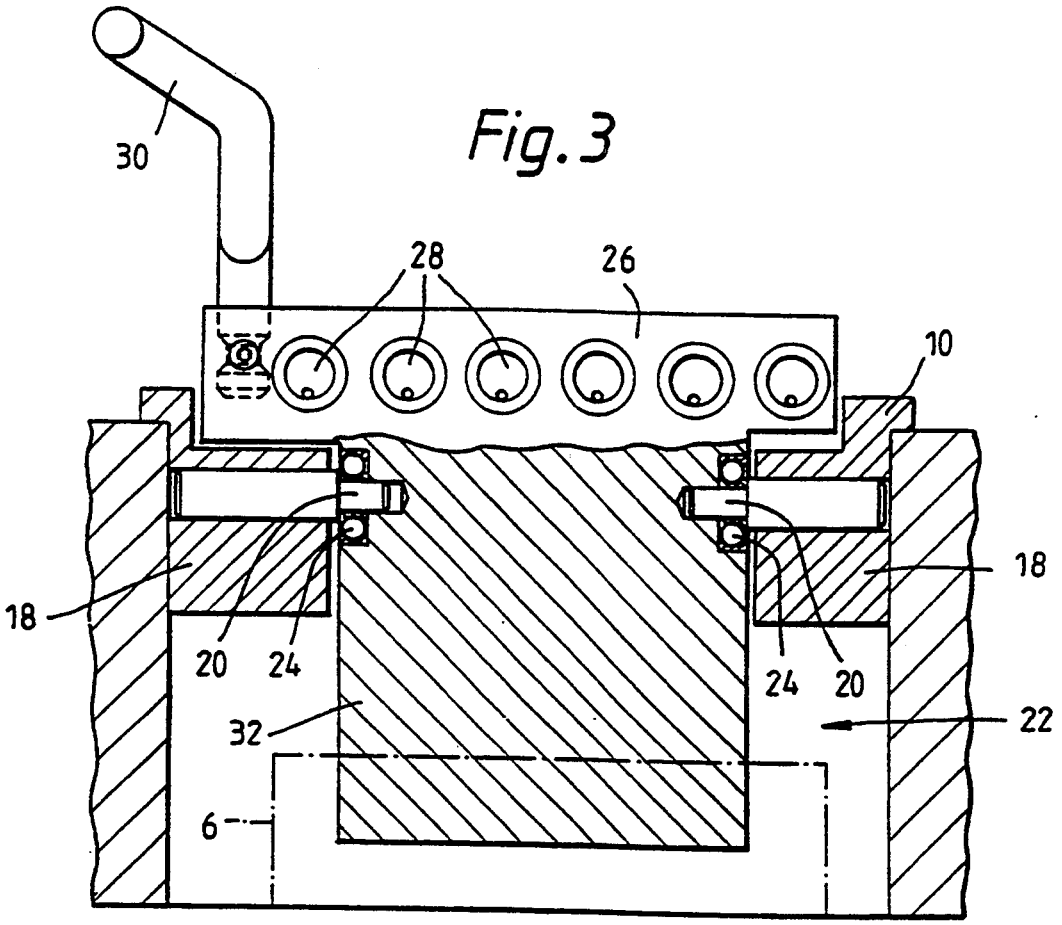
FIG. 3 is a transverse vertical section on the line 3—3 in FIG. 1.

Referring to the drawings, there is illustrated part of a guitar having a body 2 typically of wood and six strings 4. The body 2 is machined in the conventional way associated with the aforesaid Fender arrangement to include a hollow volume 6 therein of generally L-shape in longitudinal vertical section as best seen in FIG. 2. The horizontal envelope of the volume 6 is shown in dotted lines in FIG. 1. A transverse slot 8 in the upper surface of the body 2 feeds into said volume 6.

A base plate 10 incorporating a transverse slot 12 for alignment with the slot 8 is secured to the upper surface of the body 2, said base plate 10 being shaped so that it can only fit into the slot 8 if mounted correctly therein.

The base plate 10 may be screwed to the upper surface of the body 2 and/or it may be clamped to the guitar body utilising a bracket 14 integral with the base plate 10 and clamped from below by a screw (not shown) to the undersurface of a shoulder 16 formed within the body 2.

The base plate 10 includes a pair of opposed lugs 18 depending from the sides thereof through the slot 8 into the upper regions of the volume 6 within the body 2 of the guitar, a pair of coaxial stub axles 20 extending one from each lug 18 inwardly of the volume 6 to define between them a pivot axis extending transversely of the body 2 of the guitar below the upper surface thereof.

In addition to the base plate 10, the tremolo system includes a pivotal block member indicated generally at 22 in the opposed sides of which are mounted a pair of needle bearing rings 24 adapted to receive therein the free ends of the axles 20 whereby the block member is pivotal relative to the body 2 of the guitar and the fixed base plate 10 about said transverse axis.

More particularly the block member 22 is located through the slot 12 in the base plate 10 to extend substantially the width of said base plate and includes an upper portion 26 above the pivot axis to which the ends of the strings 4 of the guitar are attached, said strings 4 each conveniently extending through an associated bore 28 in the portion 26 and being secured thereto by way of increased-diameter ball ends on the strings.

Also secured to the upper surface of the portion 26 of the block member 22, adjacent the high 'E' string of the guitar, is a lever arm 30, the main extent of said arm 30 extending parallel with the strings 4 of the guitar above the upper surface of the body 2.

The block member 22 further includes a lower portion 32 below the pivot axis and of downwardly tapering shape in sections taken longitudinally of the guitar as best seen in FIG. 2, said lower portion 32 being located in the vertical extent of the L-shaped volume 6 and terminating just above the lower surface of the body 2.

A series of parallel compression springs 34, conveniently two or three springs 34, are located in the horizontal extent of the volume 6 to extend parallel with the strings 4 and to react between the bottom end of the portion 32 and the body 2 of the guitar.

A cover plate 36 mounted to the lower edge of the block member 22 prevents inadvertent removal of one end of each spring 34 from the lower portion 32 of said block member 22, while the other end of each spring 34 is adjustably secured to the body 2 whereby the tension in the springs 34 can be altered.

In the equilibrium position of the described tremolo system, the tension in the strings 4, each of which passes over an associated reverse mounted saddle assembly 38 allowing height and length adjustment thereof, is matched by the tension in the springs 34 whereby the block member is in the rest position shown in the drawings.

In order to achieve the desired variation in the pitch or tone of a sound produced by a string, the lever arm 30 is moved upwardly or downwardly after plucking the string to pivot the block 22 in a clockwise or an anticlockwise direction as viewed in FIG. 2 to increase or decrease the tension in the relevant string respectively. On release of the lever arm 30, the system automatically returns to its position of equilibrium under the influence of the strings 4 or the springs 34 depending upon the direction of movement of the lever arm 30.

The location of the transverse pivot axis of the block 22, together with the configuration of the volume 6 and the block 22, enables unimpeded movement of the lever arm, and therefore of the block 22, in either direction over the range required to achieve the desired sounds.

In particular, the location of the pivot axis below the surface of the body 2 of the instrument prevents undesirable alteration of the height of the strings 4 relative to the body 2 on movement of the lever arm 30, while the described system can be readily inserted into a conventional body 2 without the necessity for any machining thereof and without utilising any complex installation procedures.

It is also found that an instrument incorporating the described tremolo system provides excellent 'feel' to the user, a playing action comparable with the best fixed bridge instruments, excellent tonal quality, and an extended range of movement of the lever arm 30 for tremolo purposes.

Figure 5:
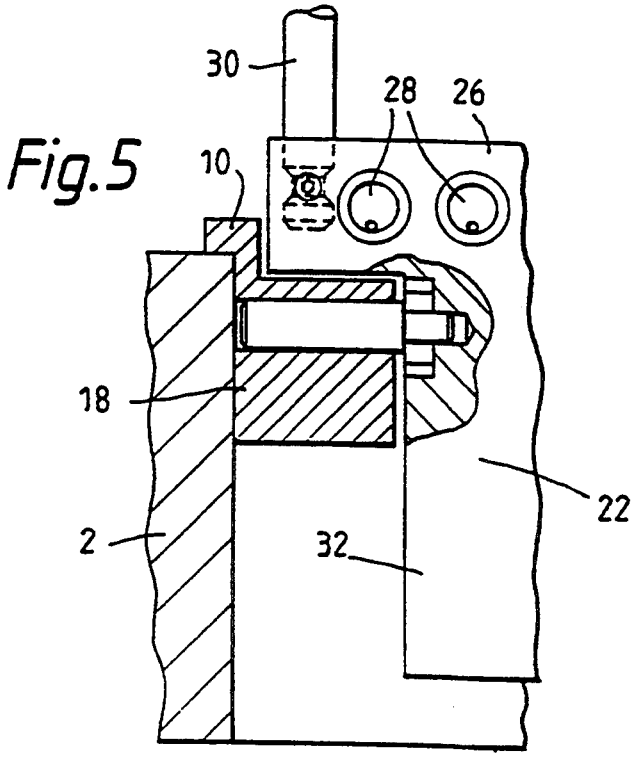
FIG. 5 is a detail of an alternative bearing assembly for the system of FIGS. 1 to 3.

The tremolo system of the invention, which can be applied to any stringed instrument, may vary in construction from that detailed above without departing from the scope of the appended claims. For example, the pivotal bearing assembly between the base plate 10 and the block 22 may be of the 'knife edge' type to provide pivotal movement of the block 22 over a limited angular range. More particularly, and referring to FIG. 5, the stub axles 20 mounted on the base plate 10 are each provided with a longitudinal V-groove therein in which are received knife edges mounted one to each side of the block 22.

Other modifications and variations will be apparent to those skilled in the art.

We claim:

1. A tremolo system for a stringed instrument having a body in an upper surface of which is formed a transverse slot feeding into a hollow volume within said body, the system being characterised by a base plate secured to the body of the instrument to surround and extend into said slot, the base plate carrying laterally opposed first bearing portions comprising a pair of opposed stub shafts mounted on the base plate located within the body of the instrument one below each end of said transverse slot, and a block member carrying second bearing portions comprising opposed annular bearing rings mounted one in each side of the block member to receive therein said stub shafts whereby the block member is pivotal about an axis extending transversely of the body of the instrument below the upper surface thereof, the block member including an upper extent projecting from the slot and to which are secured the ends of the strings and a tremolo lever, and a lower extent within said volume in the body, resilient means reacting between said lower extent of the block member and the body to maintain said block member in a rest position of equilibrium against the tension in the strings, the arrangement being such that movement of the lever pivots the block member from the rest position to a displaced position and alters the tension of the strings.

2. A tremolo system as claimed in claim 1 in which the volume within the body of the instrument is of generally L-shape in section taken longitudinally of the instrument.

3. A tremolo system as claimed in claim 2 in which a section through the lower extent of the block member in a plane extending longitudinally of the instrument tapers towards the bottom of the instrument.

4. A tremolo system as claimed in claim 2 in which the resilient means comprise a plurality of transversely-spaced compression springs one end of each of which is attached to the lower extent of the block member and the other end of each of which is attached to the body of the instrument, said springs being housed within the lower regions of said L-shaped volume and extending parallel with the strings of the instrument.

5. A tremolo system as claimed in claim 4 in which the tension in the springs is selectively adjustable.

* * * * *